US005966977A

United States Patent [19]

Engel et al.

[11] Patent Number: 5,966,977

[45] Date of Patent: Oct. 19, 1999

[54] METHOD OF ROLLING STEEL SECTIONS

[75] Inventors: Georg Engel; Paul-Josef Mauk, both of Düsseldorf, Germany

[73] Assignee: SMS Schloemann-Siemag Aktiengesellschaft, Düsseldorf, Germany

[21] Appl. No.: 09/082,880

[22] Filed: May 21, 1998

[30] Foreign Application Priority Data

May 30, 1997 [DE] Germany ..... 197 22 732

[51] Int. Cl.[6] ..... B21B 27/06; B21B 13/10

[52] U.S. Cl. ..... 72/201; 72/225

[58] Field of Search ..... 72/235, 236, 225, 72/201, 202, 200, 229, 238, 365.2, 366.2

[56] References Cited

U.S. PATENT DOCUMENTS

| | | | |
|---|---|---|---|
| 1,025,078 | 4/1912 | Vassen | 72/235 |
| 1,076,784 | 10/1913 | Puppe | 72/235 |
| 3,165,948 | 1/1965 | Kishikawa | 72/225 |

FOREIGN PATENT DOCUMENTS

| | | | |
|---|---|---|---|
| 0256409 | 2/1988 | European Pat. Off. . | |
| 0498733 | 8/1992 | European Pat. Off. . | |
| 20086 | 5/1985 | Japan | 72/236 |

OTHER PUBLICATIONS

"Stahl und Eisen" 109, (1989), No. 9, 10, pp. 497 to 502.

*Primary Examiner*—Rodney Butler
*Attorney, Agent, or Firm*—Friedrich Kueffner

[57] ABSTRACT

A method of rolling steel sections, particularly in a universal section mill, wherein X-shape rolling and H-shape rolling are carried out alternatingly and specifically directed cooling of the steel section is carried out during rolling. During roughing rolling in a X-shaped groove a cooling water channel is formed at each side of the steel section at the connecting locations between web and flange. The roll cooling water flowing off from the H-shaped rolls is concentrated in the cooling water channels. An additional quantity of water may be added either without pressure or in the form of spray water to the concentrated roll cooling water.

2 Claims, 2 Drawing Sheets

METHOD OF ROLLING STEEL SECTIONS

BACKGROUND OF THE INVENTION

1. Field of the Invention

The present invention relates to a method of rolling steel sections, particularly in a universal section mill, wherein X-shape rolling and H-shape rolling are carried out alternatingly and specifically directed cooling of the steel section is carried out during rolling.

2. Description of the Related Art

Methods and rolling mills or rolling trains for rolling steel sections or girders are well known in the art, for example, from EP-A-0 256 409 and EP-B-0 498 733. When rolling steel sections, such as H-beams, U-beams and I-beams, significantly different temperature conditions occur over the cross-section due to the mass distribution at various intermediate cross-sections. During normal or forced cooling of the rolled girders to room temperature, these temperature differences produce stresses in the section which may result in distortions and/or curvatures which reduce the load-bearing capability of the girder. These temperature differences and the effects thereof are very difficult to eliminate in the finish-rolled girder and impair or may even make entirely impossible the cooling measures to be carried out for annealing from the rolling heat or for thermomechanical rolling.

Cooling devices used in the past are based on immersion cooling or spray cooling, as disclosed by "Stahl und Eisen" 109, (1989), No. 9, 10, pages 497 to 502, for a method of the above-described type. In the thermomechanical rolling process for heavy girder sections described in this reference, the method is composed of a combination of thermomechanical treatment and selective cooling of the flange/web connecting zone during rolling. The purpose of this is to achieve a uniform temperature distribution in the flange and, thus, to improve the homogeneity of the material properties over the product cross-section. It is attempted to spray the transition or connecting zone between flange and web either from the outside toward the flange side middles, or from the inside and outside. Both measures require extensive cooling stretches with adjustable nozzles. The cooling devices are either arranged between the roughing stands or following the finishing stands. In tandem reversing trains, the cooling devices are arranged on one side of the roll stands, so that the section or girder can be cooled during roughing rolling or after the finishing pass.

SUMMARY OF THE INVENTION

Therefore, it is the primary object of the present invention to provide a method of the above-described type which makes it possible to achieve with simple means and uncomplicated constructions a more uniform temperature over a cross-section of a rolled steel section after cooling.

In accordance with the present invention, during roughing rolling in a X-shaped groove a cooling water channel is formed at each side of the steel section at the connecting locations between web and flange.

Consequently, a uniform temperature can be achieved over the cross-section of the girder section at a low level, without the use of additional cooling devices, such as particularly nozzle arrangements, in which the already existing cooling water is concentrated in the cooling water channels and, thus, in the areas of the connecting zones between web and flange, wherein this means that cooling is started at an early time, namely, during roughing rolling.

For forming the cooling water channels, it is merely necessary to roll the web so that it has a slightly upwardly directed bend, wherein, for this purpose, the horizontal rolls in the roughing stand are provided with an appropriate complimentary shape. This results in a roof-like web configuration, i.e., a configuration with web portions which are inclined downwardly toward the two flange sides, wherein the web portions together with the flanges form the channels.

In accordance with a further development of the invention, the roll cooling water flowing off from the H-shaped rolls is concentrated in the cooling water channels. The water quantity which is made available as a result ensures the desired locally increased cooling of the rolled material in the areas with a material accumulation, i.e, the connecting zones between web and flanges.

In accordance with another proposal of the present invention, an additional quantity of water is added either without pressure or in the form of spray water to the concentrated roll cooling water. Consequently, the roll cooling water which is already present can be supplemented as needed in the form of a laminar flow cooling or with a necessary or desired movement.

In accordance with a preferred embodiment of the present invention, when rolling a flange edging pass, rolling is carried out with rolls which over portions thereof are placed on the web. This essentially supported form of the cooling channel formation, in which the cooling channels are influenced by contact surfaces of the rolls of the edging stand, contributes to the achievement of a good web centricity.

In an advantageous use of the method for operating a X/H reversing tandem train, it is proposed in accordance with the present invention that at least during one pass the finishing stand is disengaged from the steel section. In that case, it is merely necessary to open the finishing stand during one or several passes, which is equivalent to an extended cooling effect; however, this also means that the productivity is reduced. When rolling is carried out in this manner, the possible cooling times result from the respective cooling duration, the rolling speeds and the reversing times and the non-productive times. On the other hand, in the case of continuous rolling, the cooling times are determined essentially by the number and lengths of the cooling stretches.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
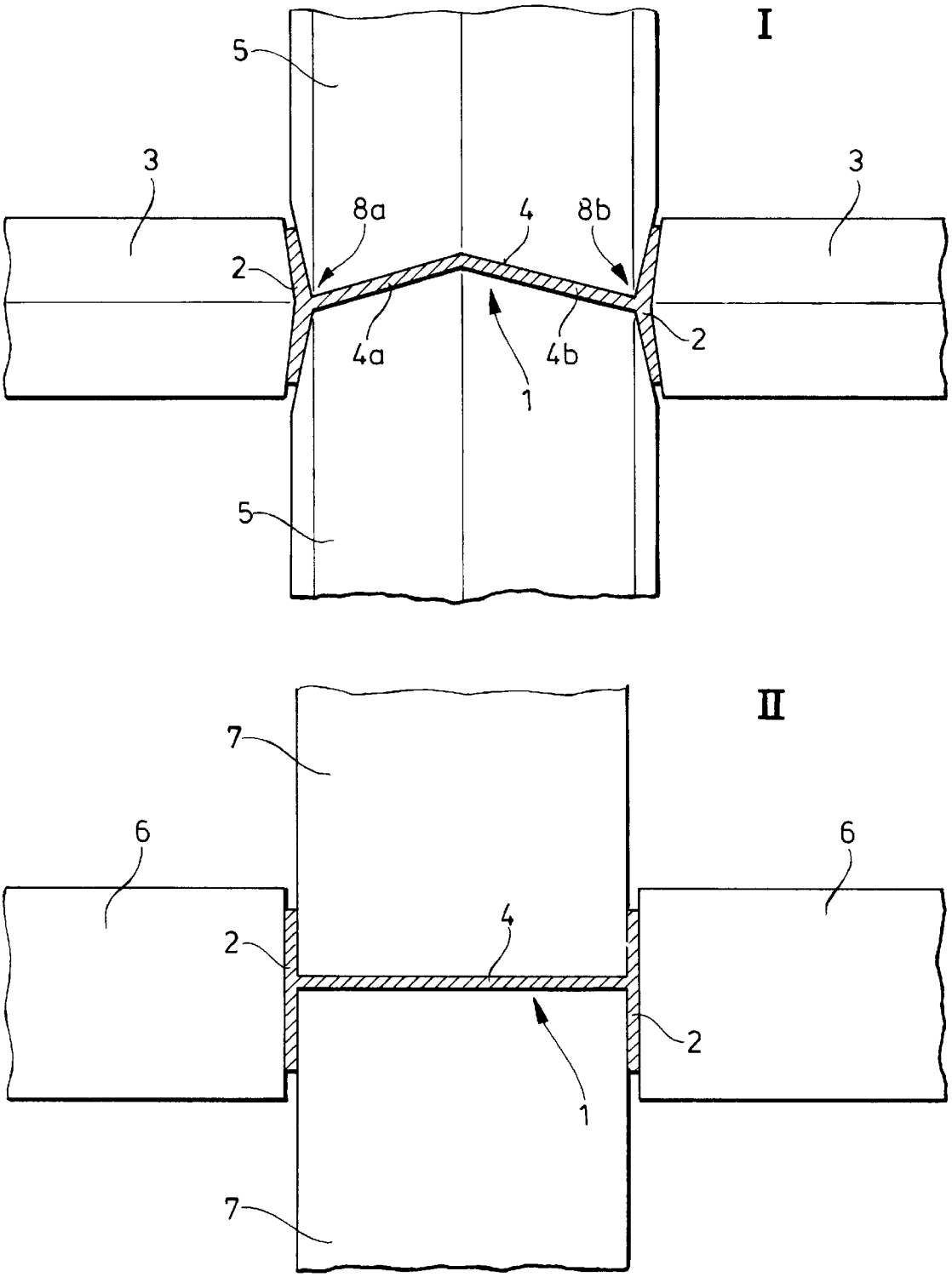
FIG. 1 shows of a rolling mill, not shown, a H-shaped roll arrangement II of a universal finishing stand and X-shaped roll arrangement I of a universal roughing stand.

In a rolling mill including a universal roughing stand I and a universal finishing stand II, as shown in FIG. 1, a H-shaped girder 1 is rolled in several passes by X/H rolling, wherein the dimensions of the girder are 600×300 mm. The edging roll arrangement of the universal roughing stand 1, which is used for carrying out the X-shape rolling, is composed of two vertical rolls 3 acting on the girder flanges 2 and two horizontal rolls 5 acting on the girder web 4. The roll arrangement of the universal finishing stand II for H-shape rolling of the girder 1 also has two vertical rolls 6 and two horizontal rolls 7; in the stand II, the final H-shaped girder I is finished in a last pass.

Of the two oppositely located horizontal rolls 5 of the universal roughing stand I, the lower horizontal roll 5 is slightly double-conically constructed in such a way that the diameter of the body of the horizontal roll 5 decreases starting form the center plane toward the roll neck, while the upper horizontal roll 5 has a complimentary indented roll contour. Consequently, during X-shape rolling, the girder web 4 assumes a roof-like configuration with two web portions 4*a* and 4*b* which are inclined downwardly toward the two girder flanges 2. In this manner, it is made possible that cooling water channels 8*a* and 8*b* are formed at the left side and also at the right side at the transition zones of the lower ends of the web portions 4*a* and 4*b* to the girder flanges 2. The roll cooling water flowing off from the H-shaped roll arrangement of the universal finishing stand II can preferably concentrate in these channels, so that the areas having greater material accumulations of the H-shaped girder 1 can be locally cooled to a greater extent.

Figure 2:
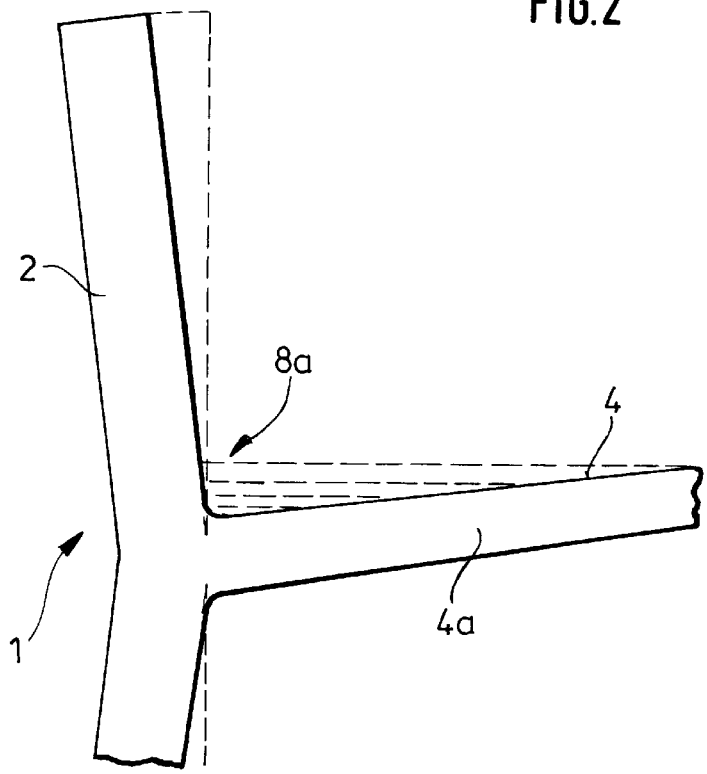
FIG. 2 shows, on a larger scale, the left half of a H-shaped girder manufactured in the universal roughing stand by X-shape rolling, with the formation of a cooling water channel in the transition zone between web and flange.
Figure 3:
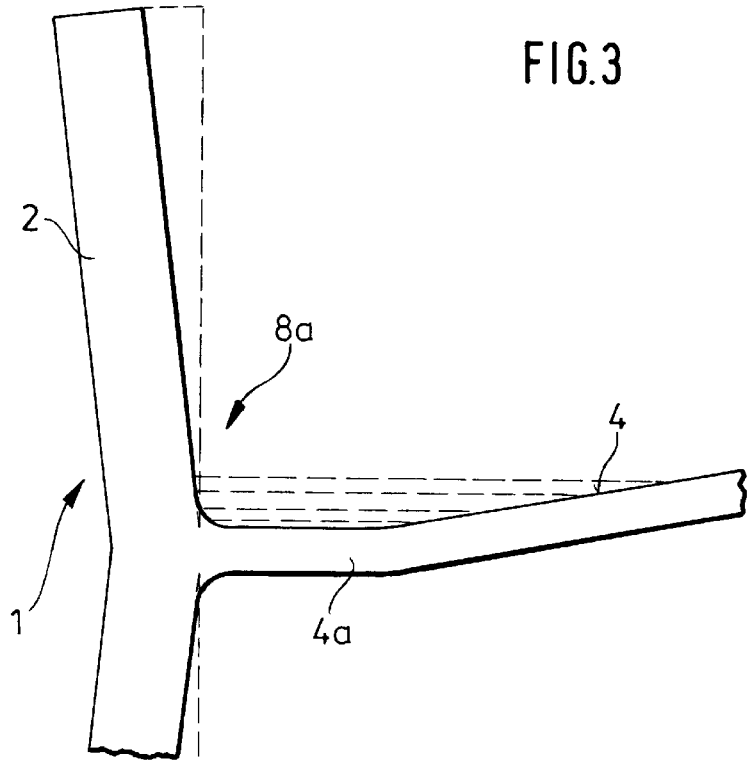
FIG. 3 is a view corresponding to FIG. 2, showing the X-shape rolling which differs from that of FIG. 2 by a horizontal edging roll being placed over portions of the web of the H-shaped girder.

The configuration of the cooling water channels 8*a* and 8*b,* and the quantity of the cooling water which may be supplemented by the supply of additional water as needed, can be dimensioned in dependence on the rolling cycles in such a way that a uniform temperature over the cross-section of the rolled girder is achieved. Also contributing to this uniform temperature is the fact that, as illustrated in FIGS. 2 and 3 for the left cooling water channel 8*a,* the flange edging pass is rolled without web contact, as in FIG. 2, or with edging rolls placed on the web 4, as in FIG. 3, which can be influenced by the contact surfaces of the edging stand. In the case of a X/H tandem reversing train, the inevitable result is that cooling is carried out always on the entry side and exit side of the universal rolling stand with X-shaped grooves.

While specific embodiments of the invention have been shown and described in detail to illustrate the inventive principles, it will be understood that the invention may be embodied otherwise without departing from such principles.

We claim:

1. In a method of rolling steel sections, particularly in a universal section mill, the method including the steps of alternating X-shape rolling in a universal roughing stand and H-shape rolling in a universal finishing stand, and cooling of the steel section during rolling, wherein the steel section has a web and two flanges connected to the web at connecting locations, the improvement comprising the steps of forming a cooling water channel at each connecting location between the web and the flanges of the steel section during roughing rolling in the universal roughing stand, concentrating roll cooling water from rolls of the universal finishing stand in the cooling water channels, and providing the web during roughing rolling in the universal roughing stand with a roof-shaped configuration with two web portions each inclined downwardly to one of the flanges.

2. The method according to claim 1, further comprising the step of disengaging the finishing stand from the steel section at least during one pass.

* * * * *